US006690367B2

(12) United States Patent
Akimoto

(10) Patent No.: US 6,690,367 B2
(45) Date of Patent: Feb. 10, 2004

(54) IMAGE DISPLAY PANEL AND IMAGE VIEWER WITH AN IMAGE DISPLAY PANEL

(75) Inventor: Hajime Akimoto, Ome (JP)

(73) Assignee: Hitachi, Ltd., Tokyo (JP)

( * ) Notice: Subject to any disclaimer, the term of this patent is extended or adjusted under 35 U.S.C. 154(b) by 233 days.

(21) Appl. No.: 09/940,498

(22) Filed: Aug. 29, 2001

(65) Prior Publication Data

US 2002/0186183 A1 Dec. 12, 2002

(30) Foreign Application Priority Data

Jun. 7, 2001 (JP) ..... 2001-172668

(51) Int. Cl.[7] ..... G09G 5/00

(52) U.S. Cl. ..... 345/211; 345/87; 345/95; 345/98

(58) Field of Search ..... 345/211, 87, 98, 345/99, 100, 95, 52

(56) References Cited

U.S. PATENT DOCUMENTS 4,384,287 A * 5/1983 Sakuma ..... 345/60
5,426,447 A * 6/1995 Lee ..... 345/103
5,995,072 A * 11/1999 Nakajima ..... 345/87

* cited by examiner

*Primary Examiner*—Dennis-Doon Chow
(74) *Attorney, Agent, or Firm*—Antonelli, Terry, Stout & Kraus, LLP

(57) ABSTRACT

There is provided an image display panel including an image region arranging pixels in matrix form, a gate-line shift register, a D/A converter, a latch circuit, a horixontal shift register, and a plurality of level shift circuits, it's signals are inputted to shift registers and latch circuit from a gate-line shift register input terminal, a latch circuit input terminal, and a horizontal shift register input terminal through level shift circuits, respectively, a signal from an image signal data input terminal is inputted to latch circuit, and all the elements are configured on an insulating substrate. It's high-voltage generating circuit includes a capacitance and a diode on insulating substrate, and clocks having an amplitude of a low voltage and a predetermined frequency are inputted from high-voltage-generating-circuit input terminals while a low constant voltage is inputted to high-voltage generating circuit to supply a high voltage to each of level shift circuits.

20 Claims, 7 Drawing Sheets

IMAGE DISPLAY PANEL AND IMAGE VIEWER WITH AN IMAGE DISPLAY PANEL

BACKGROUND OF THE INVENTION

The present invention relates to an image display panel and an image viewer of an image display apparatus which uses liquid crystals or organic light-emitting diodes and which can be manufactured at low cost.

The conventional art will be described hereafter with reference to FIG. 7.

FIG. 7 is a schematic diagram of an image display panel 150 using, for example, a low-temperature polycrystalline Si-TFT liquid crystal in accordance with a conventional example. In an image region 105, pixels 100 each having a liquid crystal capacitance 102 and a pixel switch 101 constituted by a low-temperature polycrystalline Si-TFT are arranged in matrix form, and the gate of the pixel switch 101 is connected to a gate-line shift register 106 via a gate line 103. In addition, the drain of the pixel switch 101 is connected to a D/A converter 107 via a signal line 104. An output signal from a latch circuit 108 is inputted to the D/A converter 107, and an output signal from a horizontal shift register 109 is inputted to the latch circuit 108. Signals from a gate-line shift register input terminal 121, a latch circuit input terminal 122, and a horizontal shift register input terminal 123 are inputted to the gate-line shift register 106, the latch circuit 108, and the horixontal shift register 109 via level shift circuits 111, respectively. In addition, high voltages supplied from a high-voltage input terminal 124 are applied to the respective level shift circuits 111. The level shift circuits 111 are circuits for boosting a low-voltage signal of, for example, 5 V or less inputted to the input terminals 121 to 123 to a high voltage of, for example, 13 V necessary for the operation of the registers 106 and 109 and the latch circuit 108. In addition, a signal line from an image signal data input terminal 125 is connected to the latch circuit 108. The aforementioned elements are configured on an insulating substrate such as a glass substrate. It should be noted that a description will be omitted here of general arrangements necessary for an image display apparatus other than the image display panel 150, such as color filters, peripheral drive circuits, and the like.

Hereafter, a description will be given of the operation of the above-described conventional example. A horizontal shift signal, inputted from the horizontal shift register input terminal 123 and converted by the level shift circuit 111 to a high-voltage amplitude signal corresponding to a high voltage supplied from the high-voltage input terminal 124, drives the horizontal shift register 109. The horizontal shift register 109 drives the latch circuit 108 at a predetermined timing so as to allow a first latch circuit in the latch circuit 108 to consecutively latch image signals inputted from the image signal data input terminal 125. When the image signals corresponding to the number of pixels of one horizontal line are latched by the first latch circuit in the latch circuit 108, a latch signal inputted from the latch circuit input terminal 122 and converted to a high-voltage amplitude signal by the level shift circuit 111 is inputted to the latch circuit 108 so as to allow the image signals in the aforementioned first latch circuit to be latched by a second latch circuit in the latch circuit 108. Subsequently, the image signals corresponding to the number of pixels of one horizontal line and latched by the second latch circuit are inputted in parallel to the D/A converter 107 and subjected to digital-to-analog conversion, and analog image signal voltages are outputted to the signal line 104. At this time, a gate line drive signal inputted from the gate-line shift register input terminal 121 and converted to a high-voltage amplitude signal by the level shift circuit 111 drives the gate-line shift register 106 at a predetermined timing so as to turn on the pixel switches 101 of the pixels of a predetermined row through the gate line 103. As a result, the analog image signal voltages outputted to the signal line 104 is written in the liquid crystal capacitances 102 of the pixels of the predetermined row. The liquid crystal capacitances 102 are respectively provided with counter electrodes, thereby making it possible to display an image corresponding to analog image signal voltages which are applied to the liquid crystals of the respective pixels 100.

It should be noted that, concerning the above-described conventional art, a detailed description is given in, for example, ISSCC 2000, Digest of Technical Papers, pp. 188–189.

SUMMARY OF THE INVENTION

According to the above-described conventional art, by providing the level shift circuits 111 on the insulating substrate, signals which are inputted to the respective terminals of the gate-line shift register input terminal 121, the latch circuit input terminal 122, the horizontal shift register input terminal 123, and the image signal data input terminal 125 can be set to low-voltage amplitude signals of 5 V or thereabouts.

However, with the above-described conventional art, it has been impossible to configure all the circuits for driving the image display panel 150 by only low-voltage circuits of 5 V or less which can be coped with by a general LSI. The reason for this is that to apply a high voltage of 13 V to the level shift circuits 111, it is necessary to supply a high voltage of 13 V to the high-voltage input terminal 124 from an external circuit, so that it has been inevitable to provide a high-voltage power supply circuit in a peripheral device which is different from the image display panel 150 and which is provided in the image display apparatus to drive the image display panel 150. Since a high-withstand-voltage component other than a general LSI needs to be adopted for this high-voltage power supply circuit, it is difficult to configure the entire above-mentioned peripheral device by a general low-withstand-voltage LSI, which has resulted in an increase of the manufacturing cost of the image display apparatus.

An object of the present invention is to lower the cost of the image display apparatus by realizing all the circuits such as drive circuits and the like in the peripheral device by a general LSI having a low withstand voltage of 5 V or less.

The following means is adopted in the present invention to overcome the above-described problem.

An image display panel comprising an image region 105 in which pixels are arranged in matrix form, a gate-line shift register 106, a D/a converter 107, a latch circuit 108, a horixontal shift register 109, and a plurality of level shift circuits 111, wherein signals are inputted to said shift registers 106, 109 and said latch circuit 108 from a gate-line shift register input terminal 121, a latch circuit input terminal 122, and a horizontal shift register input terminal 123 through said level shift circuits 111, respectively, and a signal from an image signal data input terminal 125 is inputted to said latch circuit 108, all the elements mentioned being configured on an insulating substrate, characterized in that a high-voltage generating circuit 212 including a capacitance and a diode is provided on said insulating substrate, and that clocks having an amplitude of a low voltage and a predetermined frequency are inputted to said high-voltage generating circuit 212 from said high-voltage-generating-circuit input terminals 213, 214, while a low constant voltage is inputted to said high-voltage generating circuit 212 from a constant-voltage input terminal 215, so as to supply a high voltage to each of said level shift circuits 111 from an output terminal 216 of said high-voltage generating circuit 212.

DESCRIPTION OF THE EMBODIMENTS

Figure 1:
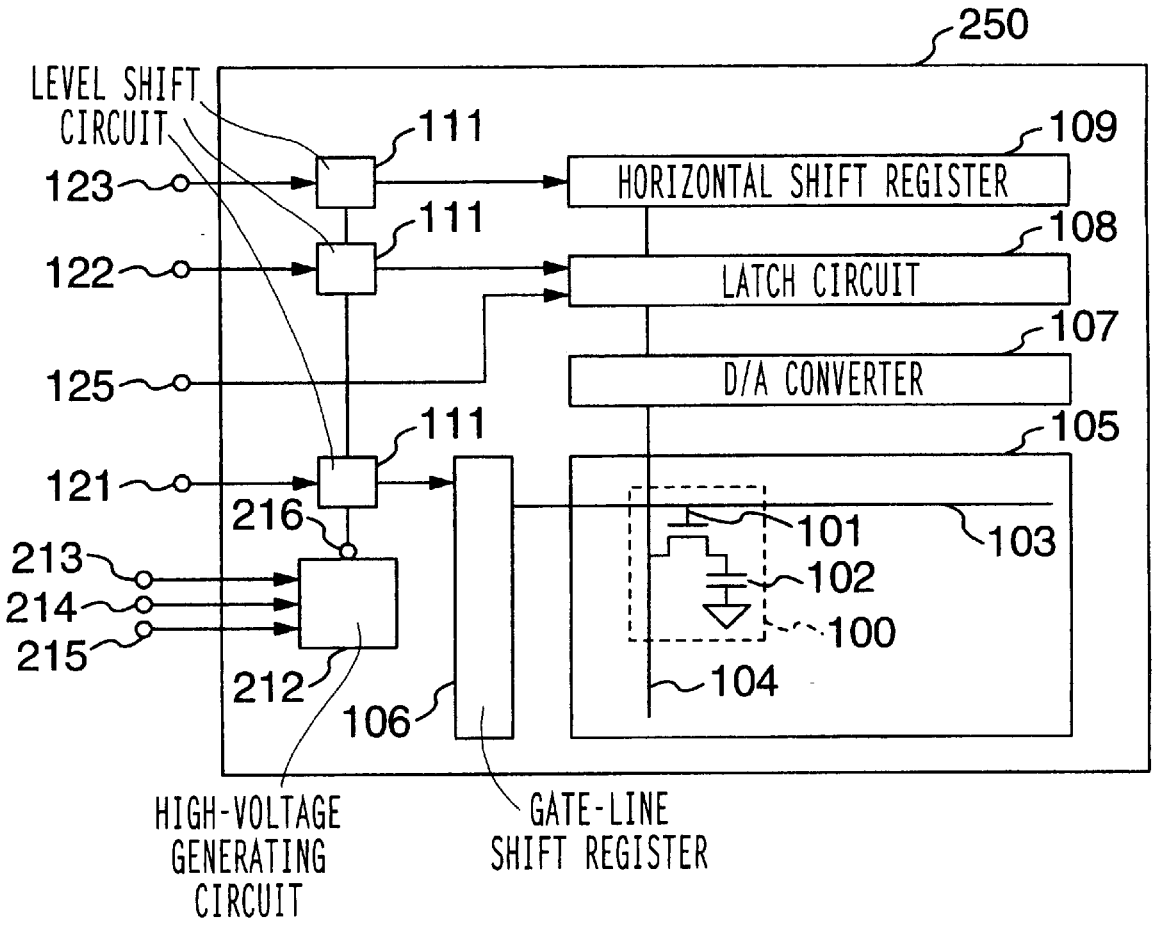
FIG. 1 shows a diagram illustrating an image display panel 250 in accordance with a first embodiment of the invention.
Figure 2:
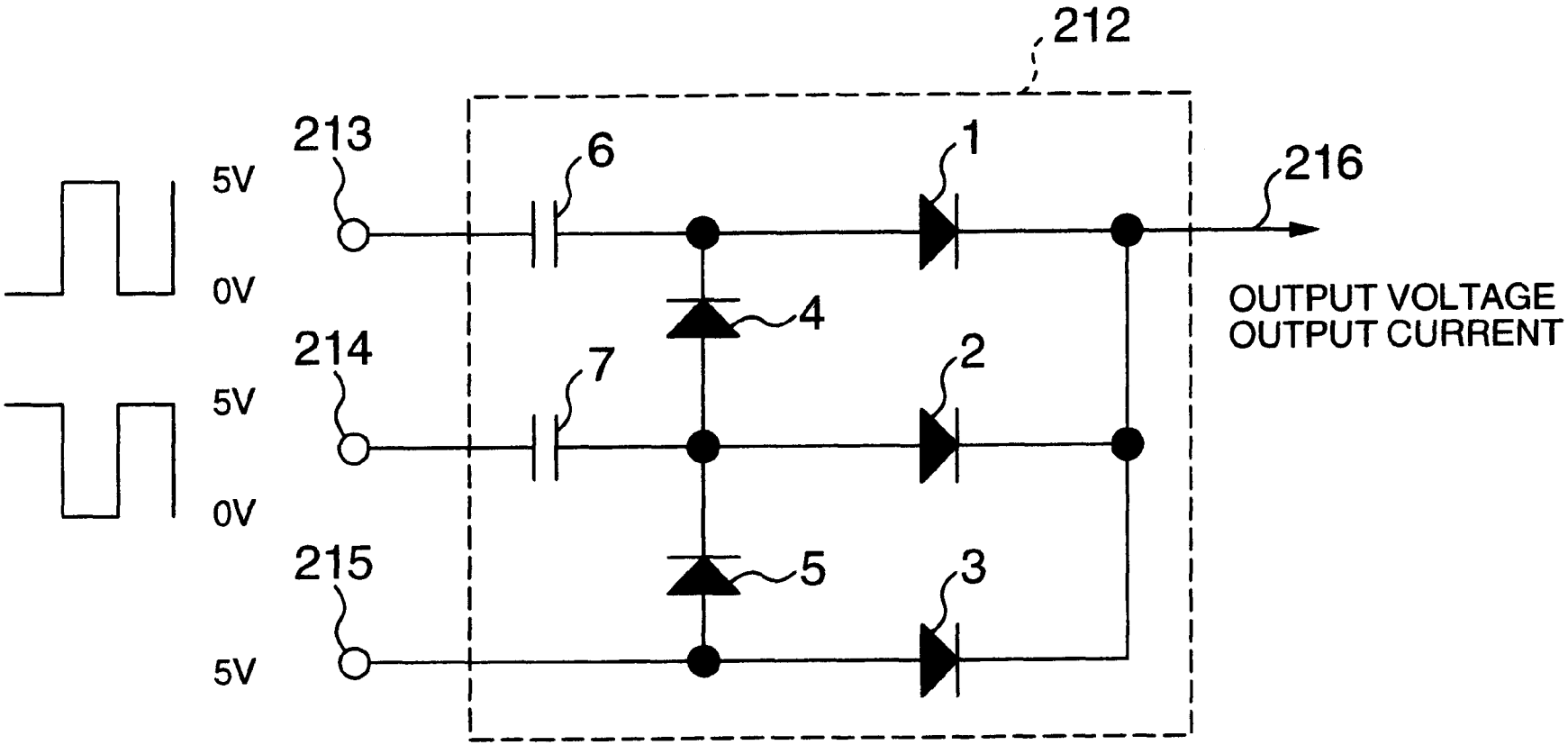
FIG. 2 shows a diagram illustrating the configuration of a high-voltage generating circuit 212 in accordance with the first embodiment of the invention.

Referring now to FIGS. 1 and 2, a description will be given of a first embodiment of the invention.

FIG. 1 is a schematic diagram of an image display panel 250 in accordance with this embodiment.

Figure 7:
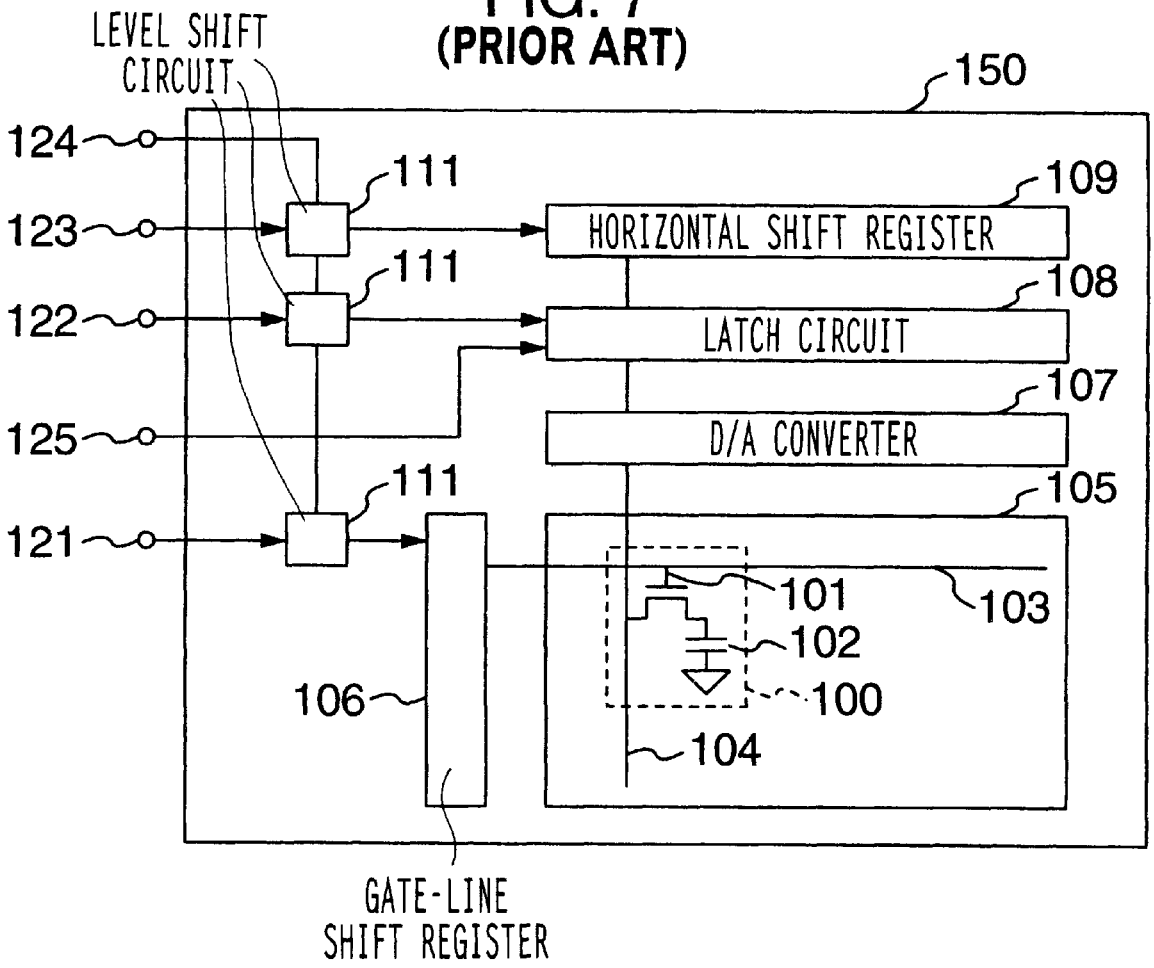
FIG. 7 (PRIOR ART)
FIG. 7 shows a diagram illustrating a conventional image display panel 150.

Since the major configuration and operation of the image display panel 250 in accordance with this embodiment are similar to those of the conventional example shown in FIG. 7 already referred to, a description thereof is omitted. In FIG. 1, the same reference numerals as those of FIG. 7 denote identical component elements. The characteristic feature of this embodiment as compared with the above-described conventional example lies in that a high-voltage generating circuit 212 for supplying a high voltage to each level shift circuit 111 is provided. Namely, to supply a high voltage to each level shift circuit 111, the high-voltage generating circuit 212 is provided, and clocks having an amplitude of 5 V and a predetermined frequency are inputted thereto from high-voltage-generating-circuit input terminals 213 and 214, while a constant voltage of 5 V is inputted thereto from a constant-voltage input terminal 215, thereby supplying a high voltage of 13 V to each level shift circuit 111 from an output terminal 216.

Next, referring to FIG. 2, a description will be given of the configuration and operation of the high-voltage generating circuit 212. FIG. 2 is a schematic diagram of the high-voltage generating circuit 212.

The high-voltage-generating-circuit input terminal 213 is connected to the output terminal 216 via a capacitance 6 and a forwardly connected diode 1. The high-voltage-generating-circuit input terminal 214 is connected to the output terminal 216 via a capacitance 7 and via a parrallel arrangement of a forwardly connected diode 2 and diodes 4 and 1 connected in series in the forward direction. The constant-voltage input terminal 215 is connected to the output terminal 216 via a parrallel arrangement of a forwardly connected diode 3, diodes 5 and 2 connected in series in the forward direction, and the diodes 5, 4, and 1 connected in series in the forward direction.

Next, a description will be given of the operation of this high-voltage generating circuit 212. As described above, clocks having an amplitude of 5 V and a predetermined identical frequency are inputted with opposite phases to the high-voltage-generating-circuit input terminals 213 and 214 of the high-voltage generating circuit 212. These clocks boost the voltage at the nodes of respective portions of the circuit through the capacitances 6 and 7 by capacitive coupling. At this time, since the diodes 4 and 5 function as voltage-controlling current switches which turn on the current when the applied voltage is forward and turn off the current when the applied voltage is reverse, an output voltage of (15–3 Vos) V (substantially 13V) is generated at the output terminal 216 by virtue of the boottrapping effect of the capacitances 6 and 7. It should be noted that Vos is an output offset voltage at the time of output of the forward current at each diode.

In this embodiment, by using such a high-voltage generating circuit 212, it is possible to set all the input voltages from an external circuit to the image display panel 250 to 5 V or less, so that all the circuits such as drive circuits and the like in the peripheral device can be realized by a general LSI having a low withstand voltage of 5 V or less, thereby making it possible to lower the cost of the system.

It should be noted that although in this embodiment, a shown in FIG. 2, the high-voltage generating circuit 212 is configured by two capacitances and five diodes so as to obtain a triple output voltage, it is possible to configure the high-voltage generating circuit 212 for obtaining a double or quadruple output voltage or more by increasing or decreasing two diodes per capacitance.

Figure 3:
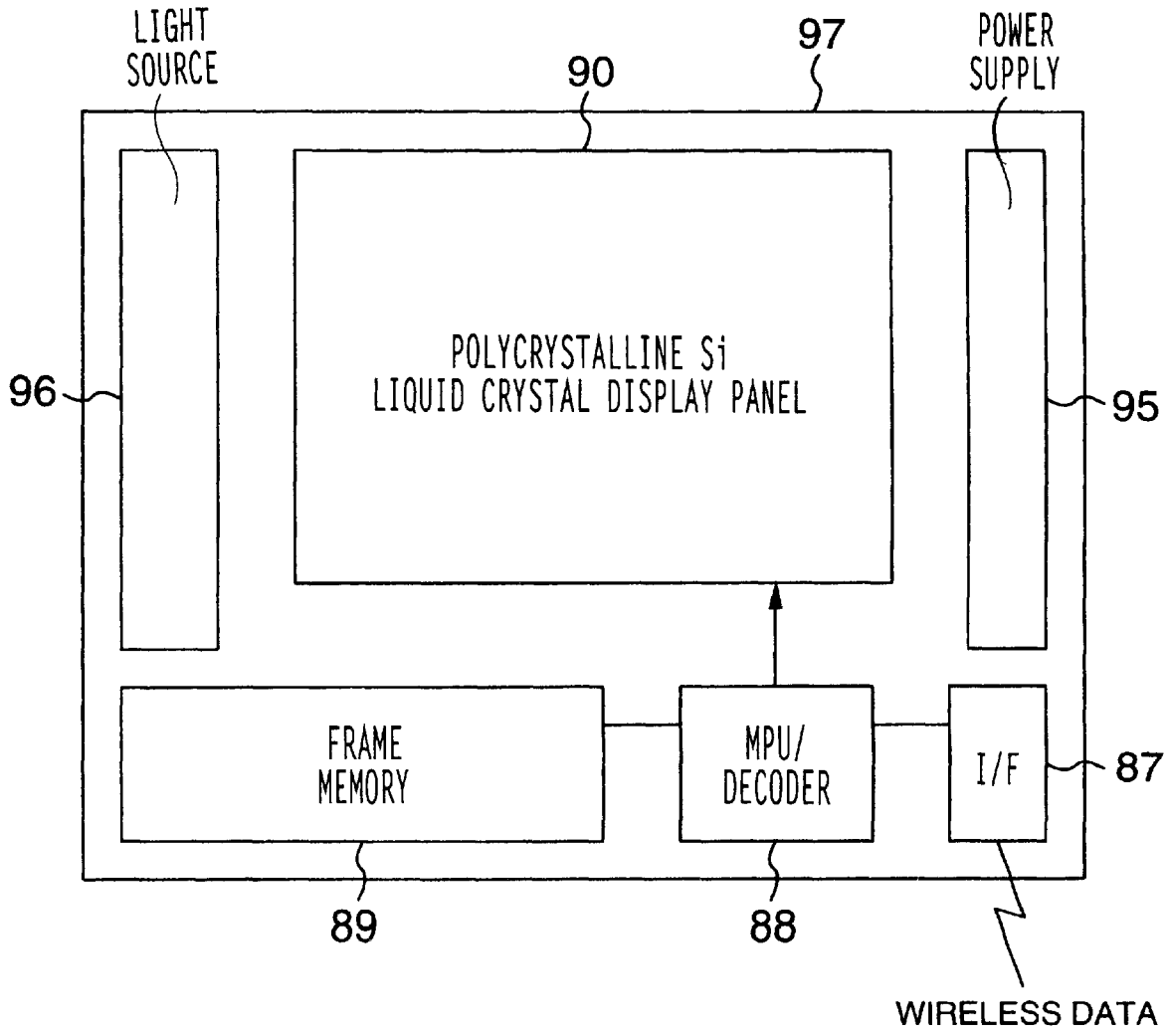
FIG. 3 shows a diagram illustrating the configuration of an image viewer 97 in accordance with a second embodiment of the invention.

Referring to FIG. 3, a description will be given of a second embodiment of the invention.

FIG. 3 is a schematic diagram of an image viewer 97.

The image viewer 97 is comprised of a wireless interface (I/F) circuit 87, an MPU/decoder 88, a frame memory 89, a polycrystalline Si liquid crystal display panel 90, a power supply 95, and a light source 96. Compressed image data is inputted from an external circuit to the wireless I/F circuit 87 as wireless data based on the bluetooth standard, and output signals from the wireless I/F circuit 87 are accumulated in the frame memory through the MPU/decoder 88. The output signal from the MPU/decoder 88 is inputted to the polycrystalline Si liquid crystal display panel 90. The polycrystalline Si liquid crystal display panel 90 has the same configuration as that of the liquid crystal display panel 250 described in the above-described first embodiment.

Hereafter, a description will be given of the operation of this embodiment. The wireless I/F circuit 87 fetches compressed image data from an external circuit, and transfers this data to the MPU/decoder 88. The MPU/decoder 88, upon operation by a user, drives an image viewer 97 or effects decode processing (processing for expanding the data back into an original form) of the compressed image data, as required. The decoded image data is temporarily stored in the frame memory 89, and outputs the image data for displaying the stored image and a predetermined drive pulse to the polycrystalline Si liquid crystal display panel 90 in accordance with an instruction of the MPU/decoder 88.

Since the displaying of the image by the polycrystalline Si liquid crystal display panel 90 by using these signals has been described in the above-described first embodiment, a detailed description thereof is omitted here. The light source 96 serves as a backlighting source, but the light source 96 need not be lit up when effecting liquid crystal display in a reflected display mode. The power supply 95 includes a secondary cell and supplies a power source for driving the overall devices.

According to this embodiment, since an image is displayed by directly driving the polycrystalline Si liquid crystal display panel 90 by the MPU/decoder 88 constituted by the LSI having an output voltage of 5V, it is unnecessary to provide a high-voltage power supply circuit, thereby making it possible to lower the cost of the image viewer 97.

Figure 4:
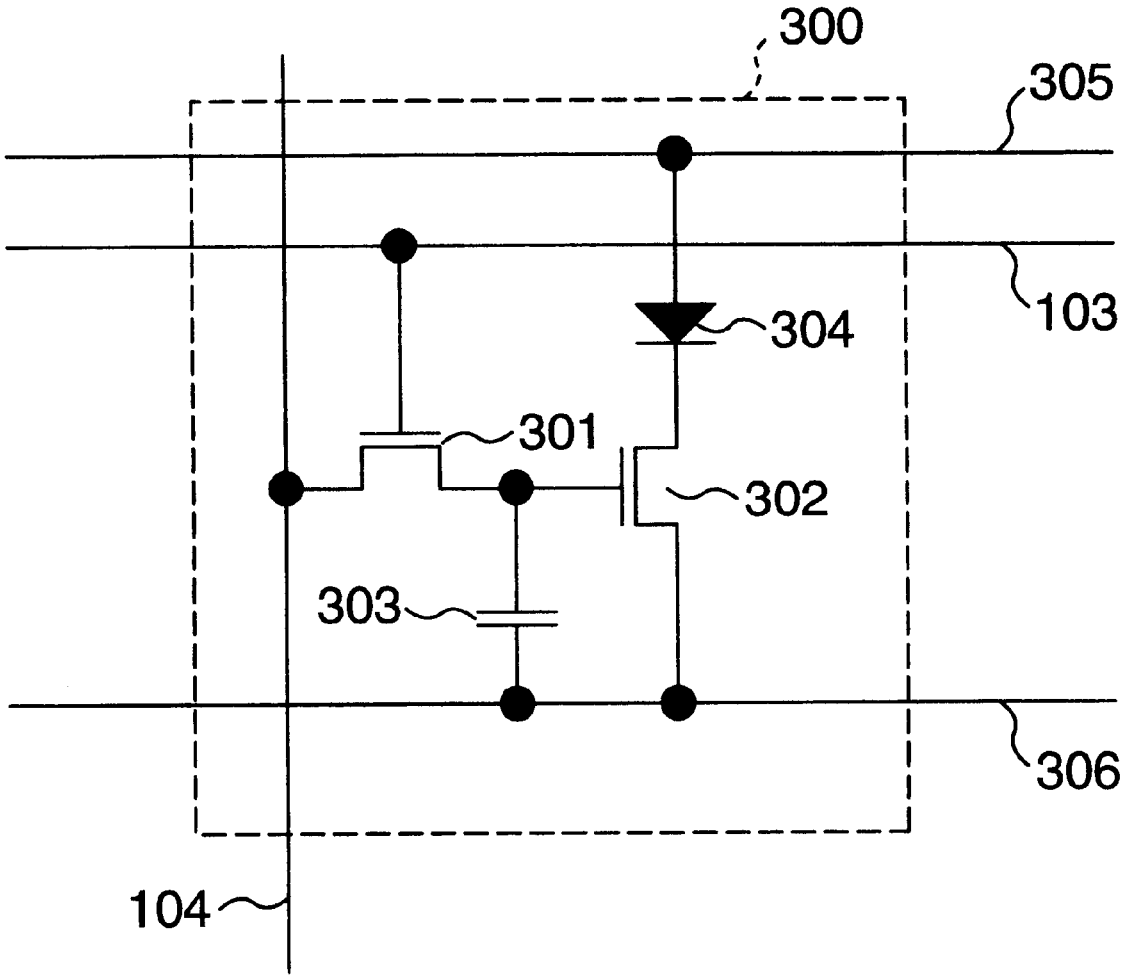
FIG. 4 shows a diagram illustrating the configuration of a pixel 300 in accordance with a third embodiment of the invention.

Referring to FIG. 4, a description will be given of a third embodiment of the invention.

Although in the first and second embodiments the liquid crystal capacitance 102 is used as the pixel 100, the third embodiment shown in FIG. 4 is characterized in that an organic light-emiting diode (OLED) is used as a pixel 300. A detailed description will be given hereafter of the third embodiment.

The pixel 300 is comprised of a pixel switch 301 which is a low-temperature polycrystalline Si-TFT having a gate connected to a gate line 103 and a drain connected to a signal line 104; a pixel driving TFT 302 which is a low-temperature polycrystalline Si-TFT having a gate connected to the source of the pixel switch 301; a holding capactance 303 having one end similarly connected to the source of the pixel switch 301; and an organic light-emiting diode 304 connected to the drain of the pixel driving TFT 302 in the forward direction. Incidentally, the source of the pixel driving TFT 302 and the other end of the holding capacitance 303 are connected to a low-voltage line 306 which is at a ground potential, while the other end of the organic light-emiting diode 304 is connected to a high-voltage power supply line 305. A high voltage is supplied to the high-voltage power supply line 305 from the outer terminal 216 of the high-voltage generating circuit 212.

In this embodiment as well, in the same way as the first embodiment, analog image signal voltages are consecutively written in the holding capacitance 303 via the pixel switch 301. The image driving TFT 302 allows a signal current corresponding to the analog image signal voltage written in the holding capacitance 303 to flow through the organic light-emitting diode 304. Consequently, the orgnic light-emitting diode 304 emits light in response to the signal current, and displays an image on the display panel.

In this embodiment, a voltage VHH applied to the high-voltage power supply line 305 is obtained from the output terminal 216 of the high-voltage generating circuit 212 of the image display panel 250 shown in FIG. 1 in the same way as in the first embodiment. Consequently, all the circuits such as drive circuits in the peripheral device can be realized by a general LSI having a low withstand voltage of 5 V or less, thereby making it possible to lower the cost of the system.

It should be noted that, as the insulating substrate in FIGS. 1 to 3, a quarts substrate or a transparent plastic substrate is used as well as the glass substrate, and if the liquid crystal display system is limited to the reflection type, it is possible to use a nontransparent substrate including an Si substrate. Furthermore, it goes without saying that various image display panels can be made within the scope which does not depart from the gist of the invention, by such as adopting a circuit configuration in which an analog input is made from an external circuit without incorporating A D/A converter and by changing the voltage values.

Figure 5:
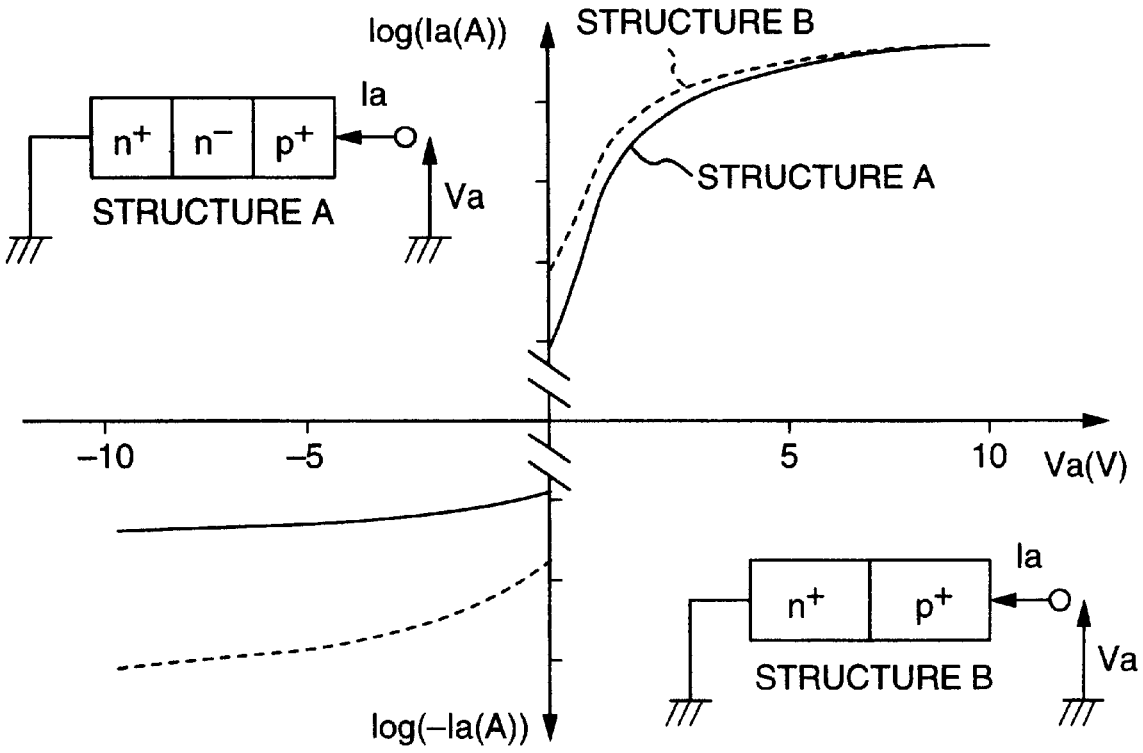
FIG. 5 shows a diagram illustrating an outline of voltage-current characteristics of lateral diodes used in a fourth embodiment of the invention.
Figure 6:
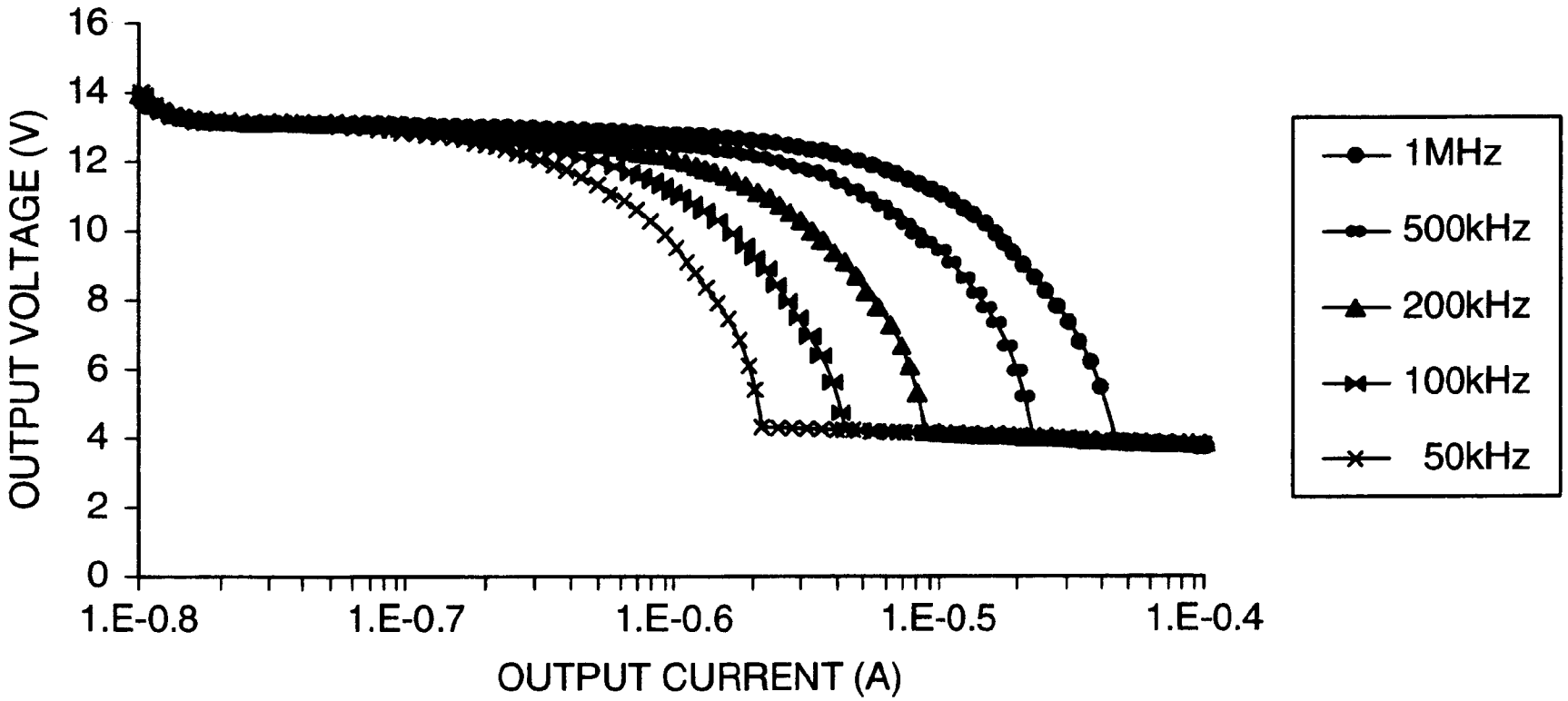
FIG. 6 shows a diagram illustrating output voltage-output current characteristics of the high-voltage generating circuit 212 in the fourth embodiment of the invention.

Referring now to FIGS. 5 and 6, a description will be given of a fourth embodiment of the invention.

In the fourth embodiment, lateral dioded having a n+/n−/p+ structure are used as the diodes in the high-voltage generating circuit 212 in the first to third embodiments of the invention. Hereafter, a detailed description will be given of the fourth embodiment of the invention.

FIG. 5 is a diagram illustrating an outline of respective characteristics between a voltage Va and a current Ia in a lateral diode having the n+/n−/p+ structure (hereafter referred to as a "structure A," the length of an n− region oriented parallel to the current being 3 $\mu$m), which is the characteristic feature of the fourth embodiment, and in a lateral diode having the conventionally known n+/p+ structure (hereafter a "structure B"). Here, "n+" and "p+" represent that the concentrations of impurities in the n+ region and the p+ region are high to a sufficiently saturated extent at $10^{20}/cm^3$ or more, while "n−" represents that the concentration of impurities in the n− region is low in the vicinity of $10^{18}/cm^3$. In addition, the ordinate shows current characteristics by logarithms. To simply an understanding, the characteristics at the time of application of a forward voltage and the characteristics at the time of application of a reverse voltage are collectively shown in a first quadrant and a third quadrant, respectively. It can be appreciated from FIG. 5 that although there is not a very large difference in the characteristics between the two structures A and B at the time of application of the forward voltage, but that there is a difference on the order of several digits between the two structures A and B at the time of application of the reverse voltage. Namely, in the case where the diodes of the structure A are used, the reverse current is very small. For this reason, as a result of the fact that improvement is made on the functions of the diodes 4 and 5 in the high-voltage generating circuit 212 as voltate-controlling current switches for switching on in the forward direction and switching off in the reverse direction, particularly the functions of turning off in the reverse direction, as compared with the structure B a higher and stabler output voltage can be obtained and the power consumtion becomes smaller.

FIG. 6 is an output voltage-output current characteristic diagram at the output end 216 in the case where the diodes of the structure A are used as the diodes 1 to 5 of the high-voltage generating circuit 212 shown in FIG. 2. In FIG. 6, characteristics are shown in which the frequencies of the 5 V amplitude clocks inputted to the high-voltage-generating-circuit input terminals 213 and 214 were varied into five frequencies, and in each case extremely stable output voltage characteristics were obtained at the output current of 0.1 $\mu$A or less which was the design value. In addition, since the output offset voltages Vos of the diodes were stable as described above, a plurality of samples showed no variations in characteristics and were extremely stable. It should be noted that since the circuitry is configured by using TFTs in the invention, it suffices if the diodes are formed in the same process as that for thin films of the channels of the TFTs, and since they are provided on the insulating substrate, the p-type and n-type terminals are respectively automatically separated in terms of circuits. It is not appropriate to use diode-connected TFTs instead of the diodes.

In this embodiment, in addition to the advantage that the cost of the image display apparatus can be lowered by using the high-voltage generating circuit 212 as described in the first to third embodiments, there are advantages in that by using the above-described diodes of the structure A, it is possible to suppress the reverse leak current, stablize the output voltage characteristics of the high-voltage generating circuit 212, and obtain a sufficiently high voltage, and that it is possible to lower power consumption.

In accordance with the invention, it is possible to lower the cost of the image display apparatus by realizing all the circuits such as drive circuits and the like in the peripheral device by a general LSI having a low withstand voltage of 5 V or less.

What is claimed is:

1. An image display panel including an image region in which pixels are arranged in matrix form, a gate-line shift register, a D/a converter, a latch circuit, a horixontal shift register, and a plurality of level shift circuits, wherein said shift registers and said latch circuit input signals from a gate-line shift register input terminal, a latch circuit input terminal, and a horizontal shift register input terminal through said level shift circuits, respectively, and said latch circuit inputs, a signal from an image signal data input terminal, are configured on an insulating substrate, characterized, comprising:

a high-voltage generating circuit including a capacitance and a diode is provided on said insulating substrate, and by inputting clocks having an amplitude of a low voltage and a predetermined frequency from said high-voltage-generating-circuit input terminals, and inputting a low constant voltage from a constant-voltage input terminal, a high voltage is supplied to each of said level shift circuits from an output terminal.

2. The image display panel according to claim 1, wherein a plurality of capacitances and a plurality of high-voltage-generating-circuit input terminals corresponding thereto are used.

3. The image display panel according to claim 2, wherein said diode is formed by a polycrystalline Si-TFT diode.

4. The image display panel according to claim 3, wherein said polycrystalline Si-TFT diode has an impurity region n− with a low concentration of $10^{18}/cm^3$ or less between an n-type high-concentration impurity region n+ and a p-type high-concentration impurity region p+.

5. The image display panel according to claim 3, wherein a transparent plate is used as said insulating substrate.

6. The image display panel according to claim 3, wherein each of said pixels has a liquid crystal capacitance.

7. The image display panel according to claim 2, wherein a transparent plate is used as said insulating substrate.

8. The image display panel according to claim 2, wherein each of said pixels has a liquid crystal capacitance.

9. The image display panel according to claim 2, wherein each of said pixels has an organic light-emitting diode.

10. An image viewer characterized by comprising said image display panel according to claim 2, a wireless interface (I/F) circuit, an MPU/decoder, a frame memory, a power supply, and a light source.

11. The image display panel according to claim 1, wherein said diode is formed by a polycrystalline Si-TFT diode.

12. The image display panel according to claim 11, wherein said polycrystalline Si-TFT diode has an impurity region n− with a low concentration of $10^{18}/cm^3$ or less between an n-type high-concentration impurity region n+ and a p-type high-concentration impurity region p+.

13. The image display panel according to claim 11, wherein a transparent plate is used as said insulating substrate.

14. The image display panel according to claim 11, wherein each of said pixels has a liquid crystal capacitance.

15. The image display panel according to claim 11, wherein each of said pixels has an organic light-emitting diode.

16. An image viewer characterized by comprising said image display panel according to claim 11, a wireless interface (I/F) circuit, an MPU/decoder, a frame memory, a power supply, and a light source.

17. The image display panel according to claim 1, wherein a transparent plate is used as said insulating substrate.

18. The image display panel according to claim 1, wherein each of said pixels has a liquid crystal capacitance.

19. The image display panel according to claim 1, wherein each of said pixels has an organic light-emitting diode.

20. An image viewer characterized by comprising said image display panel according to claim 1, a wireless interface (I/F) circuit, an MPU/decoder, a frame memory, a power supply, and a light source.

* * * * *